US006016928A

United States Patent [19]

Cothran et al.

[11] Patent Number: 6,016,928

[45] Date of Patent: Jan. 25, 2000

[54] BACKSTOP FOR WIRE DECKING

[75] Inventors: Stephen M. Cothran, Cedar Hill; Thomas H. Peay, Antioch, both of Tenn.

[73] Assignee: Nashville Wire Products Co., Nashville, Tenn.

[21] Appl. No.: 09/245,559

[22] Filed: Feb. 5, 1999

[51] Int. Cl.[7] ..... A47F 5/00

[52] U.S. Cl. ..... 211/183; 211/90.03; 211/175; 211/184; 68/61; 68/181

[58] Field of Search ..... 211/183, 181.1, 211/90.01, 90.02, 90.03, 90.04, 175, 184, 106, 119.003; 108/61, 181

[56] References Cited

U.S. PATENT DOCUMENTS

| | | | |
|---|---|---|---|
| 3,358,956 | 12/1967 | Thornton . | |
| 3,703,964 | 11/1972 | Field | 211/184 |
| 3,739,918 | 6/1973 | Kreitzburg | 211/44 |
| 3,877,580 | 4/1975 | Hammar | 211/184 |
| 4,023,682 | 5/1977 | Niece | 211/184 |
| 4,437,572 | 3/1984 | Hoffman | 211/119.003 X |
| 4,693,382 | 9/1987 | Galen | 211/189 |
| 4,729,485 | 3/1988 | Kulbersh | 211/184 |
| 4,776,472 | 10/1988 | Rosen | 211/175 X |
| 5,082,125 | 1/1992 | Ninni | 211/184 |
| 5,103,799 | 4/1992 | Atanasio | 211/181.1 X |
| 5,133,463 | 7/1992 | Merl | 211/181.1 X |
| 5,148,927 | 9/1992 | Gebka | 211/184 |
| 5,437,380 | 8/1995 | Peay et al. | 211/184 |

OTHER PUBLICATIONS

Exhibit A—brochure of Nashville Wire Products entitled POLYCRON®.

Exhibit B—Drawing illustrating the manner in which a hanging divider has been used as a backstop (undated but the structure shown therein is admitted to be a part of the prior art).

Exhibit C—Drawing of a wire deck panel having an integral backstop formed therewith (undated but is admitted to be a part of the prior art).

*Primary Examiner*—Robert W. Gibson, Jr.

*Attorney, Agent, or Firm*—Lucian Wayne Beavers

[57] ABSTRACT

A removable wire backstop apparatus is provided for use with an industrial wire decking. The wire backstop apparatus includes a rear wall structure and a plurality of dog-legged support members extending from the rear wall structure for removable engagement with the wire decking. The wire backstop apparatus can be installed in an interlocking engagement with conventional wire decking panels without the need for any tools. It can be quickly removed and reinstalled in any desired location. One manner of installation provides that the wire backstop apparatus extend laterally beyond a rear edge of the wire deck panel so as to provide a deck extension.

18 Claims, 2 Drawing Sheets

BACKSTOP FOR WIRE DECKING

BACKGROUND OF THE INVENTION

1. Field of The Invention

The present invention relates generally to a removable backstop structure for use with wire decking used in industrial storage applications.

2. Description of the Prior Art

One commonly used type of industrial shelving material is referred to as wire decking. A wire decking system typically includes a column and beam support framework made from steel channels, with individual removable panels of wire decking spanning between the beams of the framework. One example of such conventional prior art wire decking is the system sold by the assignee of the present invention, Nashville Wire Products, of Nashville, Tenn. under its READY DECK® trademark.

The prior art includes several structures which are intended to provide the ability to divide the surface of the wire decking into various zones or the like.

U.S. Pat. No. 5,437,380 to Peay, et al. and assigned to the assignee of the present invention, which is incorporated herein by reference, discloses a system of vertical wire panel dividers sold by Nashville Wire Products under the trademark KWIK KLIP. The system of the Peay, et al. patent utilizes a wire clip having a lateral opening which is received about one of the wires of the grid of the wire decking in order to hold the vertical wire panel in place relative to the wire decking.

U.S. Pat. No. 4,729,485 to Kulbersh discloses another vertical divider structure for wire decking which has posts received in holes defined through removable clips.

Another prior art system is the use of wire hanging dividers. A wire hanging divider panel for use with one level of wire decking is actually supported from a second layer of wire decking located above the layer which is being divided. Such hanging dividers have been used as backstops to provide a vertical panel running along the rear edge of the level of wire decking in question.

The purpose of a backstop is to prevent boxes and other materials which are being stored on the wire decking from inadvertently falling off the wire decking over the rear edge of the deck.

One other prior art technique which has been utilized to provide a backstop on wire decking is to manufacture the wire deck panel with an integral upturned relatively short vertical panel member.

Thus while the prior art does provide several techniques for providing backstops and/or other vertical divider panels for use with wire decking, none have ever proved completely satisfactory. What is needed is a wire decking accessory which allows a backstop or vertical divider panel to be selectively located at any desired position on the wire decking and to be installed and removed quickly without the need for tools or any lengthy installation procedure. It is also preferable that such a structure be supported from the level of the wire decking with which it is associated, rather than to be suspended from upper layers or the like.

SUMMARY OF THE INVENTION

The present invention provides a removable backstop apparatus for use on wire decking. The apparatus includes a rear wall structure and a plurality of dog-legged support members extending from the rear wall structure for removable engagement with the wire decking. Each of the support members includes an upper horizontal portion extending from the rear wall structure, a lower horizontal portion, and a dog-leg joining the upper and lower horizontal portions.

Preferably at least two of the support members include a wire clip attached to the lower horizontal portion. The wire clip includes a lateral opening facing toward the dog-leg. The wire clip is spaced from the dog-leg by an integral multiple of a depthwise wire spacing of the wire decking with which the backstop apparatus is to be utilized.

This construction allows the removable backstop to be easily installed by tilting the support leg members, inserting them downward through the grid of the wire decking, tilting the support leg back to a horizontal position with the wire clip adjacent one of the wires of the wire deck grid, and then sliding the backstop structure horizontally until the wire clips engage the adjacent wire of the wire decking.

One particular advantage provided by the structure is that it may be arranged so that the support legs actually extend over the rear edge of the wire decking to provide an extension of the wire decking. Thus the structure provides a combination wire deck extension and backstop which is quickly installable and removable.

It is therefore a general object of the present invention to provide improved methods and apparatus for installing vertical dividers and backstops on a wire decking assembly.

Another object of the present invention is the provision of a removable wire deck extension.

Still another object of the present invention is the provision of a backstop apparatus which can be easily installed or removed without the need for tools.

Other and further objects, features and advantages of the present invention will be readily apparent to those skilled in the art upon reading of the following disclosure when taken in conjunction with the accompanying drawings.

BRIEF DESCRIPTION OF THE DRAWINGS

In FIG. 3 the removable backstop is being inserted into engagement with the wire decking. In FIG. 4 the removable backstop has been pivoted to a position wherein its support members are aligned with the wire decking. In FIG. 5 the removable backstop has been moved in a horizontal direction to engage its wire clips with one of the wires of the wire decking so as to hold the backstop structure in place relative to the wire decking.

DETAILED DESCRIPTION OF THE PREFERRED EMBODIMENTS

Figure 1:
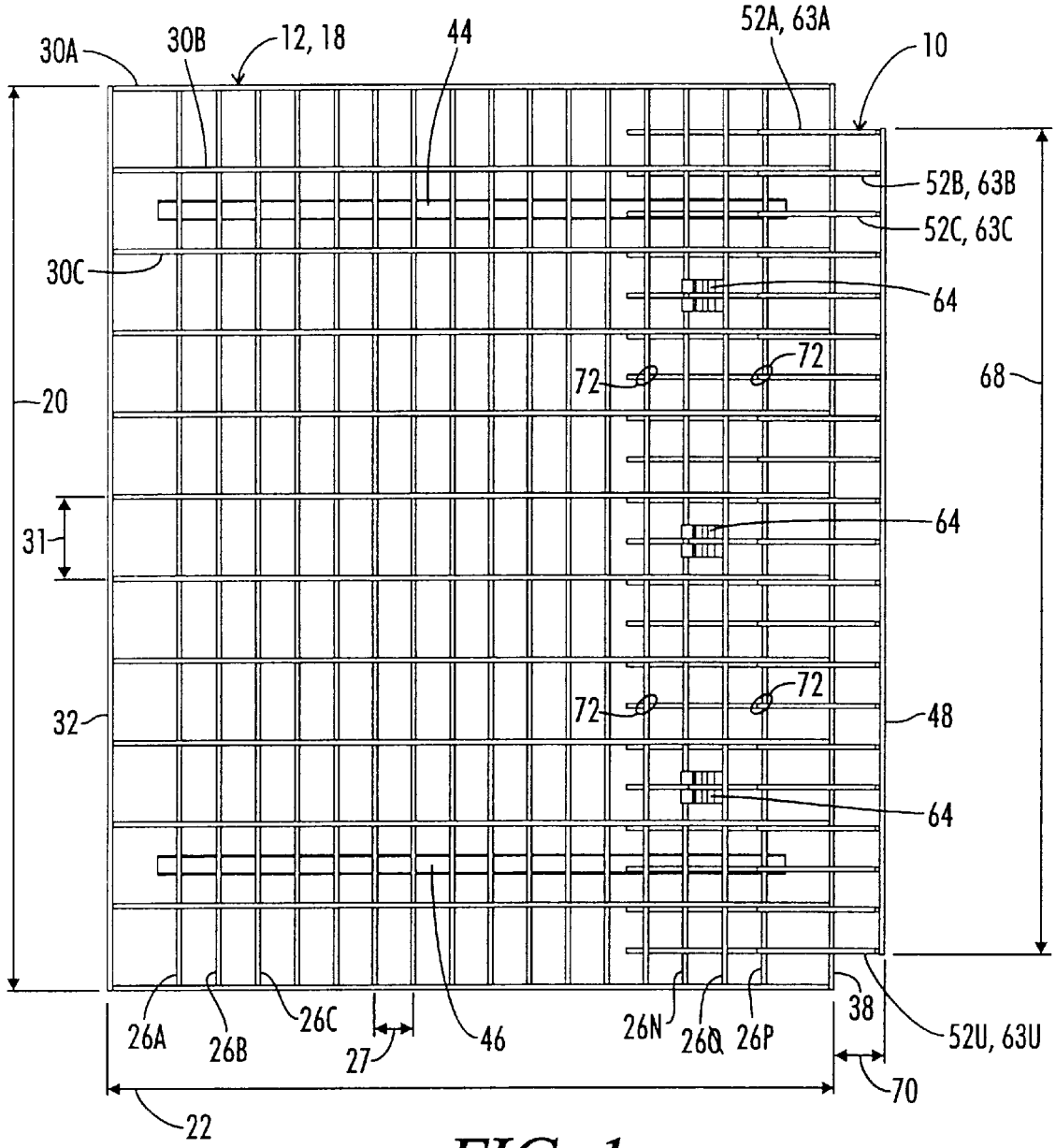
FIG. 1 is a plan view of a wire decking panel having the removable backstop of the present invention installed thereon.
Figure 2:
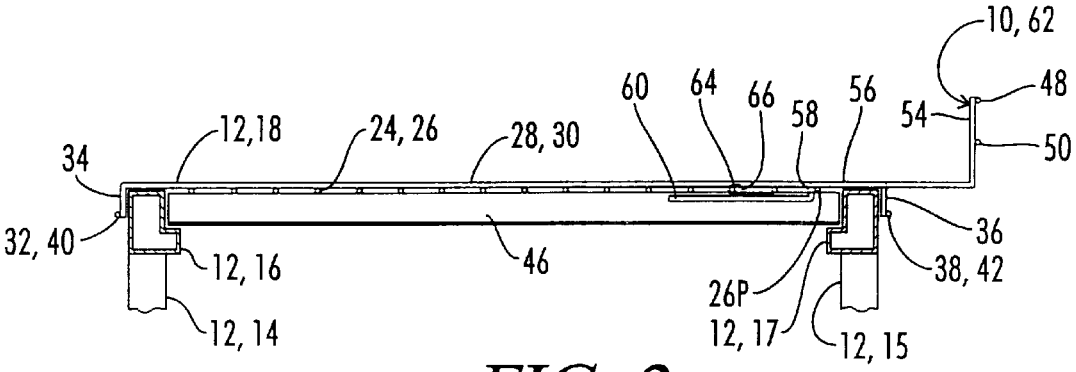
FIG. 2 is an end elevation view of the assembly of FIG. 1.

Turning now to the drawings, and particularly to FIGS. 1 and 2, a removable backstop structure shown and generally designated by the numeral 10 is shown in assembled engagement with a wire deck 12.

The Prior Art Wire Decking

The wire deck 12 is itself a part of the prior art. A typical construction for the wire deck 12 is as follows.

As shown in FIG. 2, the wire deck 12 includes a structural frame work made up of column members 14 and 15 and beam members 16 and 17. Supported from and spanning between the beam members 16 and 17 are wire deck panels such as the panel 18.

It is noted that the support structure columns 14 and beam 16 are not shown in FIG. 1 in order to simplify that illustration.

One of the wire deck panels 18 is shown in plan view in FIG. 1. The wire deck panel 18 has a length 20 and a depth 22. A typical length 20 is 44 inches, and a typical depth 22 is 38 inches.

The wire deck panel 18 comprises a wire gridwork which includes a lower layer 24 of parallel lengthwise wires 26 and an upper layer 28 of parallel depthwise wires 30. The lengthwise and depthwise wires 26 and 30 are welded together where they cross. For ease of reference, in FIG. 1 the parallel lengthwise wires 26 are designated as 26A, 26B, 26C, etc. beginning with the frontmost of the wires. Similarly, the depthwise parallel wires 30 of the upper layer 28 are designated as 30A, 30B, 30C, etc., being identified from left to right as they would be viewed by a person standing in front of a forward edge 32 of the wire deck panel 18.

As seen in FIG. 2, the depthwise wires 30 are turned down at their ends such as indicated by downwardly bent portions 34 at the forward edge 32 of the wire deck panel 18, and downward bends 36 at the rearward edge 38 of the wire deck panel 18.

It is noted that all of the lengthwise wires 26 in the lower layer 24 are equidistantly spaced by a distance 27 as seen in FIG. 1. The distance 27 is typically two inches on the center lines of adjacent wires 26.

The depthwise wire members each have an equi-distant spacing 31 which in the embodiment illustrated is four inches.

The downwardly bent portions 34 at the forward edge 32 are joined by a lengthwise wire 40 which may be said to form the forward edge 32. Similarly, the downwardly turned portions 36 adjacent rear edge 38 are joined by a single lengthwise wire 42 which may be said to define the rear edge 38.

Finally, the wire deck panel 18 includes first and second depthwise support channels 44 and 46 which are welded to the lower wire layer 24.

The Removable Backstop Apparatus

The removable wire backstop 10 is made up of two lengthwise extending wires 48 and 50 and a plurality of lateral wire members 52A, 52B, 52C, etc. Each of the lateral wire members 52 includes a vertical backstop section 54, a first horizontal section 56 extending forward from the vertical backstop section 54, an offset leg or dog-leg 58 extending downward from the first horizontal section 56 and a second horizontal section 60 extending forward from the offset leg 58. The vertical length of the dog-legs 58 are generally equal to twice the thickness of the wire making up the wire decking so that the upper horizontal portion 56 can lay in the plane of the upper lay 28 of wires while the lower horizontal portion 60 can lay below and engage the lower layer 24 of wires.

The removable wire backstop 10 may be described as including a backstop wall 62 made up of the vertical backstop sections 54 of the lateral wire members and the upper and lower lengthwise wires 48 and 50.

The first horizontal section 56, offset leg or dog-leg 58, and second horizontal section 60 of each lateral wire member 52 may be collectively referred to as a support arm 63 extending from the backstop wall 62 into removable interlocking engagement with the wire deck 18. Support arms 63 may be generally referred to as dog-legged support members extending from the rear wall structure 62.

As seen in FIG. 1, a plurality of the support arms 63, but not all of the support arms 63, have wire clips 64 welded thereto. The wire clips 64 are constructed similar to the clips disclosed in U.S. Pat. No. 5,437,380. Each of the clips 64 is shaped to form a rearward facing lateral opening 66.

Figure 5:
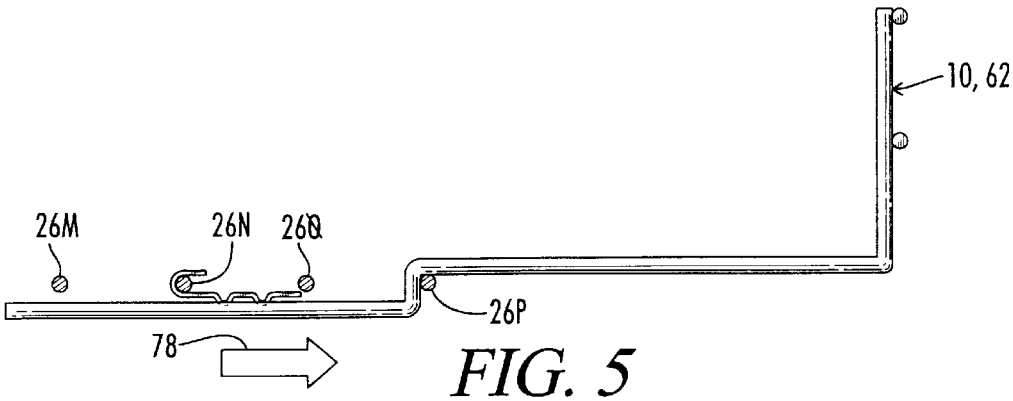

As best seen in FIGS. 2 and 5, when the wire backstop 10 is assembled with the wire decking 12, the first horizontal sections 56 of each lateral wire member 52 are parallel to and at the same elevation as the upper layer 28 of depthwise wires 30 of the wire decking panel 18, and the first horizontal sections 56 rest upon at least one of the lengthwise wires 26. In the embodiment illustrated in FIGS. 1 and 2, the first horizontal section 56 of each lateral wire member 52 rests upon the lengthwise wire member 26P. The offset or dog-leg section 58 of each lateral wire member 52 extends downward through the gridwork of the wire deck panel 18 so that the second horizontal section 60 underlies and engages at least one of the lengthwise wires 26 of wire deck panel 18. Another one of the lengthwise wires 26N is received within the lateral opening 66 of the wire clips 64.

As previously noted the lengthwise wires 26 are equidistantly spaced by a distance 27 therebetween adjacent wires. The wire clip 64 is spaced from the offset leg 58 of its respective lateral wire member 52 by twice the distance 27, so that when one lengthwise wire member 26N is received within the lateral openings 66 of the clips 64, another of the lengthwise wire members 26P is snugly engaged in the corner defined between first horizontal member 56 and dog-leg member 58 thus providing a firmly engaged, yet removable connection between the wire backstop apparatus 10 and the wire deck panel 18.

In general, the lateral opening 66 of wire clip 64 may be said to be spaced from the offset leg 58 by an integral multiple of the equidistant spacing 27 between adjacent lengthwise wire members 26. The spacing could for example be one, two, three or four times the distance 27.

Preferably the wire deck panel 18 and the removable wire backstop apparatus 10 are made from equal diameter wires.

As seen in FIG. 1, the removable wire backstop apparatus 10 has a length 68 which is shorter than the length 20 of the wire deck panel 18.

As is also seen in FIG. 1, the dimensions of the lateral wire members 52 are such that the removable backstop apparatus 10 can be assembled with the wire deck panel 18 in the manner illustrated in FIG. 1, so that the uppermost horizontal sections 56 of each lateral wire member 52 extend rearward by a overhang distance 70 beyond rear edge 38 of wire back panel 18. In the assembly as shown in FIG. 1, the overhang distance 70 is equal to the spacing 27 between adjacent lengthwise wire members 26, and thus provides an overhang distance 70 of two inches. In the embodiment illustrated, that overhang distance 70 can be increased up to four inches by removing the backstop 10 and reassembling it such that the wire clip 64 engages lengthwise wire member 26O and the dog-leg 58 is adjacent the beam 17 with the first horizontal member 56 resting directly upon the beam 17.

Once the apparatus 10 is installed in a desired location upon the wire deck grid 18 it is preferably temporarily secured in place with removable plastic ties such as schematically illustrated at 72.

Methods of Installation

Referring now to the sequential series of FIGS. 3, 4 and 5, the manner of installation of the wire backstop 10 with the wire decking panel 18 will be described.

Figure 3:
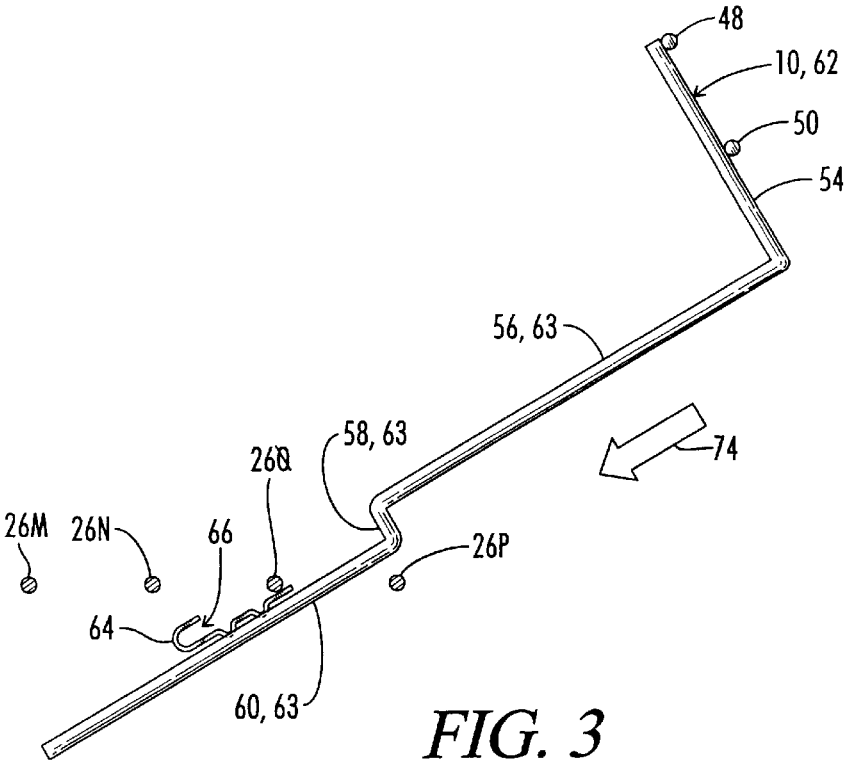
FIGS. 3, 4 and 5 are a sequential series of schematic illustrations showing the manner in which the removable backstop structure is installed upon the wire decking.
Figure 4:
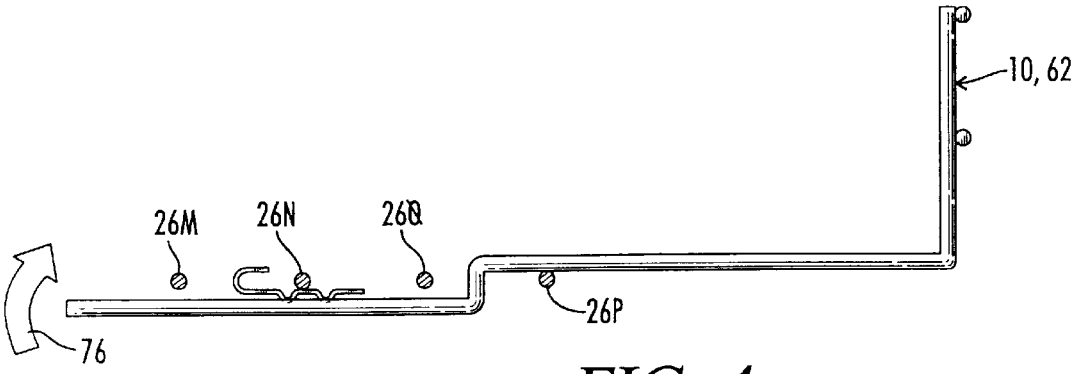

In FIGS. 3, 4 and 5, three of the lengthwise wire members 26N, 26O and 26P are shown in cross-section.

The lateral wire members 52 are tilted to a non-horizontal position as seen in FIG. 3 and then are inserted downward between lengthwise wire members 26O and 26P of the grid work of the wire deck panel 18. This insertion is represented by the arrow 74.

Then, the backstop apparatus 10 is tilted in a clockwise direction as indicated by arrow 76 in FIG. 4 so that the upper horizontal portion 56 of each of the lateral arms 63 rests on lengthwise wire member 26P and on top of the beam 17, while the lower horizontal section 60 of each lateral arm 63 engages the lengthwise wire members 26N and 26O from below. Then, the backstop apparatus 10 must slide rearwardly as indicated by arrow 78 in FIG. 5 until the lengthwise wire member 26N is snugly received within the lateral opening 66 of wire clip 64 and the dog-leg 58 snugly abuts the rearward most lengthwise wire member 26P as seen in FIG. 5.

It will be appreciated that by simply reversing the steps just described, the backstop apparatus 10 can be removed from the wire deck panel 18 and it can then be reinstalled in any desired position.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are embodied within the scope and spirit of the present invention as defined by the appended claims.

What is claimed is:

1. A removable backstop apparatus for use on wire decking, comprising:

a rear wall structure;

a first plurality of dog-legged support members extending from the rear wall structure for removable engagement with the wire decking, each support member including an upper horizontal portion extending from the rear wall structure, a lower horizontal portion, and a dog-leg joining the upper and lower horizontal portions; and at least two additional support members each including a wire clip.

2. The apparatus of claim 1, wherein:

the wire clip includes a lateral opening facing toward the dog-leg.

3. The apparatus of claim 1, wherein:

the wire clip is spaced from the dog-leg by an integral multiple of a depthwise wire spacing of the wire decking with which the backstop apparatus is to be used.

4. The apparatus of claim 1, wherein:

a vertical distance between the upper and lower horizontal portions of each support member of said first plurality is equal to twice the thickness of the wire of the wire decking with which the backstop apparatus is to be used.

5. The apparatus of claim 1, wherein:

the rear wall structure includes a plurality of horizontal wires running a length of the rear wall structure, and a plurality of vertical wires connecting the horizontal wires; and each of the support members is made of wire and is an integral extension of one of the vertical wires of the rear wall structure.

6. A decking assembly, comprising:

a wire decking having a length and a depth, the wire decking including a lower layer of parallel lengthwise wires and an upper layer of parallel depthwise wires; and a removable wire backstop including:

a backstop wall; and a plurality of wire support arms each having a first section extending forward from the backstop wall parallel to and at the same elevation as the depthwise wires of the wire decking and resting upon at least one of the lengthwise wires, an offset leg extending downward from the first section, and a second section extending forward from the offset leg under at least two of the lengthwise wires and engaging at least one of the lengthwise wires.

7. The decking assembly of claim 6, further comprising:

a wire clip attached to the second section of one of the support arms, the wire clip including a rearward facing lateral opening within which one of the lengthwise wires of the wire decking is received.

8. The decking assembly of claim 7, wherein:

a majority of the lengthwise wires of the wire decking are equally spaced; and the wire clip is spaced from the offset leg by an integral multiple of said equal spacing.

9. The decking assembly of claim 6, wherein:

the wire decking and the removable wire backstop are made from equal diameter wire.

10. The decking assembly of claim 6, wherein:

a length of the removable wire backstop is shorter than a length of the wire decking.

11. The decking assembly of claim 6, further comprising:

a plurality of plastic ties securing the removable wire backstop in place on the wire decking.

12. The decking assembly of claim 6, wherein:

the wire decking has a rear edge; and the support arms overhang the rear edge of the wire decking to provide a deck extension.

13. The decking assembly of claim 12, wherein:

a majority of the lengthwise wires of the wire decking are equally spaced by a first distance; and the support arms overhang the rear edge of the deck by a distance equal to an integral multiple of said first distance.

14. A method of installing a backstop on a wire decking, comprising:

(a) providing the backstop with a plurality of support members, at least two of which support members include a wire clip;

(b) tilting the support members to a non-horizontal position;

(c) inserting the support members downward through the wire decking;

(d) tilting the support members back to a horizontal position wherein at least some of the support members include one portion of each support member resting upon the wire decking and another portion of each support member extending laterally under the wire decking; and (e) sliding the backstop rearwardly and engaging the wire clips with a lengthwise wire of the wire decking.

15. The method of claim 14, wherein:

step (a) includes providing each of the support members with a vertical offset; and terminating the sliding step by abutting said offsets against a lengthwise wire of the wire decking.

16. The method of claim 14, further comprising:

extending the support members rearward of a rear edge of the wire decking and thereby providing a deck extension.

17. The method of claim 14, further comprising:

removing the backstop from the wire decking by reversing steps (e), (d), (c) and (b).

18. The method of claim 17, further comprising:

reinstalling the backstop in a different location on the wire decking by repeating steps (b), (c), (d) and (e).

* * * * *